United States Patent [19]

Gross

[11] Patent Number: 4,899,748

[45] Date of Patent: Feb. 13, 1990

[54] DEVICE FOR REMOVING HAIR

[75] Inventor: Joseph Gross, Moshav Mazor, Israel

[73] Assignee: Hair Remover Ltd., Tel Aviv, Israel

[21] Appl. No.: 237,127

[22] Filed: Aug. 25, 1988

[30] Foreign Application Priority Data

Mar. 25, 1988 [IL] Israel ..... 85867

[51] Int. Cl.[4] ..... A61B 17/00

[52] U.S. Cl. ..... 606/133; 17/11.1 R

[58] Field of Search ..... 128/355; 17/47, 11.1 R; 132/73.6

[56] References Cited

U.S. PATENT DOCUMENTS 4,079,741 3/1978 Paar et al. ..... 128/355

4,726,375 2/1988 Gross et al. ..... 128/355

*Primary Examiner*—Michael H. Thaler

*Attorney, Agent, or Firm*—Benjamin J. Barish

[57] ABSTRACT

A depilatory device for removing body hair, comprises a manually-grippable housing, two hair-plucker bodies each rotatably mounted to the housing and each having an exposed section formed with a plurality of gaps in its outer surface which open and close during the rotation of the hair-plucker body to receive, pluck and eject body hair growing on a surface over which the hair-plucker body is moved, and a drive for driving the hair-plucker bodies in opposite directions.

19 Claims, 1 Drawing Sheet

DEVICE FOR REMOVING HAIR

RELATED APPLICATIONS AND PATENT

The present application is related to U.S. Pat. No. 4,726,375 which issued Feb. 23, 1988, and also to pending patent application Nos. 07/163,356 now U.S. Pat. Nos. 4,807,624 and 07/163,047, now U.S. Pat. No. 4,825,867.

BACKGROUND OF THE INVENTION

The present invention relates to a depilatory device, namely to a device for removing body hair, such as are used for cosmetic purposes. The invention is particularly useful with respect to the depilatory device described in U.S. Pat. No. 4,726,375, which issued Feb. 23, 1988, and is therefore described below particularly with respect to that patent.

U.S. Pat. No. 4,726,375 describes a novel depilatory device for removing hair, comprising: a manually-grippable housing, and a hair-plucker body rotatably mounted to the housing and having an exposed section formed with a plurality of gaps in its outer surface which open and close during the rotation of the hair-plucker body to receive, pluck, and eject body hair growing on a surface over which the hair-plucker body is moved. In the device of that application, the hair-plucker body is a flexible cylindrical member of plastic material, preferably a natural or synthetic elastomeric material, having a smooth outer surface formed with a plurality of slits penetrating only partially through the plastic cylindrical member and extending circumferentially thereof. The plastic cylindrical member is rotated about its longitudinal axis and is supported in an arcuate position such that the slits open at the convex side of the plastic cylindrical member during its rotation to receive the hairs between the open confronting faces of the slits, and close at the concave side of the plastic cylindrical member during its rotation to clamp the hairs between the closed confronting faces of the slits and thereby to pluck them during the rotation of the cylindrical members.

That patent application describes a number of important advantages provided by such a construction over the previously-known depilatory devices, particularly the helical-spring type. These advantages include a softer feel to the skin, less possibility of "pinching" the skin, a much larger surface area for contacting and clamping the hairs thereby making the device more effective to remove shorter hairs; a substantial reduction in the danger of electrical shock in having a non-conductive member contacting the skin; and the substantial reduction in the expense in having the hair-plucker body made of a simple plastic cylindrical member which may be manufactured in volume and at low cost.

An object of the present invention is to provide further improvements in depilatory devices in general, and particularly in the depilatory device of U.S. Pat. No. 4,726,375.

BRIEF SUMMARY OF THE INVENTION

Thus, according to the present invention, there is provided a depilatory device for removing body hair, comprising: a manually-grippable housing; two hair-plucker bodies each rotatably mounted to the housing and each having an exposed section formed with a plurality of gaps in its outer surface which open and close during the rotation of the respective hair-plucker body to receive, pluck and eject body hair growing on a surface over which the hair-plucker bodies are moved; and a drive for driving the hair-plucker bodies in opposite directions. Each of the hair-plucker bodies includes a flexible member having a cylindrical outer surface formed with the plurality of gaps extending circumferentially thereof. The two flexible members are individually supported to define two oppositely-extending arcs having concave sides facing each other and convex sides facing away from each other. The two members are rotated in opposite directions such that the gaps of one member open at its convex side and thereby tend to receive hairs leaning in one direction, and the gaps of the other member open at its convex side and thereby tend to receive hairs leaning in the opposite direction, the gaps of both members closing at their concave sides to clamp the hairs and to pluck them out during the rotation of the two members An important advantage in the above novel construction, particularly in providing the two counter-rotating hair-plucker bodies, is that the device is less sensitive to the direction in which it is moved across the user's skin. Thus, body hair does not project perpendicularly from the skin but rather leans at an angle in one direction towards the skin: the hair-plucker body, to be most effective, should be moved in the opposite direction from that at which the hair leans. By using a depilatory device including two counter-rotating hair-plucker bodies, there is better assurance that all the hairs will be effectively engaged in the proper direction by one or the other of the hair-plucker bodies as both are moved together across the user-skin. In addition, the combined surfaces of the hair-plucker bodies are doubled, as compared to a device including only one such body, thereby more rapidly removing the body hair.

As indicated earlier, the invention of the present application is preferably incorporated in a depilatory device according to U.S. Pat. No. 4,726,375, wherein each of the hair-plucker bodies is a flexible cylindrical member of plastic material having a smooth outer surface formed with a plurality of slits penetrating only partially through the plastic cylindrical member and extending circumferentially thereof. The two plastic cylindrical members supported in arcuate positions, would thus be rotated about their longitudinal axes in opposite directions such that their slits open at their convex sides to receive the hairs between the open confronting faces of the slits, and close at their concave sides to clamp the hairs between the closed confronting faces of the slits and to pluck them out during the rotation of the cylindrical member.

According to a further important feature in the preferred embodiment of the invention described below, one of the hair-plucker bodies is directly coupled to the electric motor within the housing and includes a gear, such as a bevel gear, coupled to a gear carried by the other hair-plucker body so as to rotate it in the opposite direction; also, one of the ends of each of the two hair-plucker bodies is rotatably mounted within the housing, and the other end of each of the two hair-plucker bodies is rotatably mounted to a stem projecting axially of the housing.

Further features and advantages of the invention will be apparent from the description below.

BRIEF DESCRIPTION OF THE DRAWINGS

The invention is herein described, by way of example only, with reference to the accompanying drawings, wherein.

DESCRIPTION OF A PREFERRED EMBODIMENT

Figure 1:
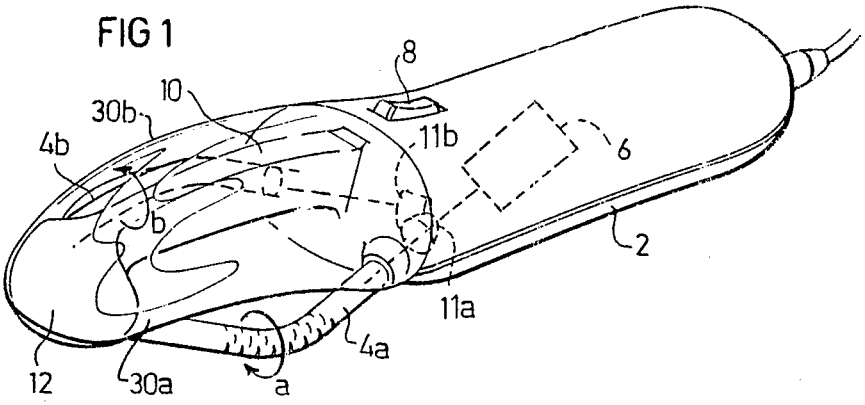
FIG. 1 illustrates one form of depilatory device constructed in accordance with the present invention.

The depilatory device illustrated in the drawings comprises a manually-grippable housing 2 and a pair of hair-plucker bodies 4*a*, 4*b* rotatably mounted to the housing and rotated by an electric motor 6 within the housing and energized by an electrical switch 8. One end of each of the two hair-plucker bodies 4*a*, 4*b* is rotatably mounted within the housing 2, whereas the opposite ends are rotatably mounted to the outer end of a stem 10 projecting axially from the housing.

More particularly, motor 6 is mounted within housing 8 at an angle to the longitudinal axis of the housing, in alignment with the end of hair-plucker body 4*a* disposed within the housing, and is directly coupled to that end of hair-plucker body 4*a*. That end of hairplucker body 4*a* carries a bevel gear 11*a* which is coupled to another bevel gear 11*b* carried by the end of the other hair-plucker body 4*b* rotatably mounted within housing 2, such that the two hair-plucker bodies 4*a* and 4*b* are rotated in opposite directions. That is, hair-plucker body 4*a* is rotated in the clockwise direction as shown by arrow "a" in FIG. 1, whereas hair-plucker body 4*b* is rotated in the counter-clockwise direction as shown by arrow "b".

The opposite ends of the two hair-plucker bodies 4*a*, 4*b* are mounted in rotary bearings 12*a*, 12*b* carried by a crossbar 12 at the outer end of stem 10. The spacing between crossbar 12 and the ends of the hair-plucker bodies 4*a*, 4*b* mounted within housing 2 is such that the two hair-plucker bodies are supported in the form of an arc whose outer surfaces are of convex shape and inner surfaces are of concave shape.

Figure 2:
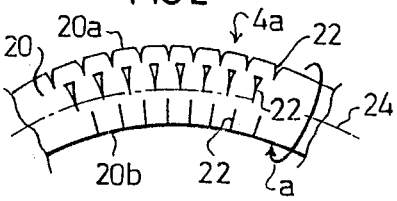
FIG. 2 is an enlarged fragmentary view illustrating the construction of one of the hairplucker bodies in the device of FIG. 1.

FIG. 2 more particularly illustrates the construction of each of the hair-plucker bodies 4*a*, 4*b*. Thus, each such body is in the form of a cylinder 20 of flexible plastic material, e.g., a natural or synthetic elastomer. Each body includes a smooth outer surface formed with a plurality of discrete slits 22 extending only partially through the cylinder and extending in a circumferential direction thereof, but preferably for a length less than its complete circumference, e.g. for less than one-half its complete circumference. Thus, by supporting the respective hair-plucker body 4*a* (or 4*b*) in the illustrated arcuate shape, its outer convex surface 20*a* is tensioned, and therefore its slits 22 are opened or widened; whereas its inner concave surface 20*b* is compressed, and therefore its slits 22 are closed. Accordingly, as such of the cylindrical members 20 of the respective hair-plucker bodies 4*a* and 4*b* rotates about its longitudinal axis 24 by motor 6, the slits 22 will open at the convex surfaces 20*a* and will close at the concave surfaces 20*b*.

The hairs plucked by the inner surfaces of the two hair-plucking bodies 4*a*, 4*b* are ejected upwardly against either the stem 10 or against transparent shields 30*a*, 30*b* fixed to the opposite sides of stem 10 and overlying the two hair-plucker bodies.

Figure 3:
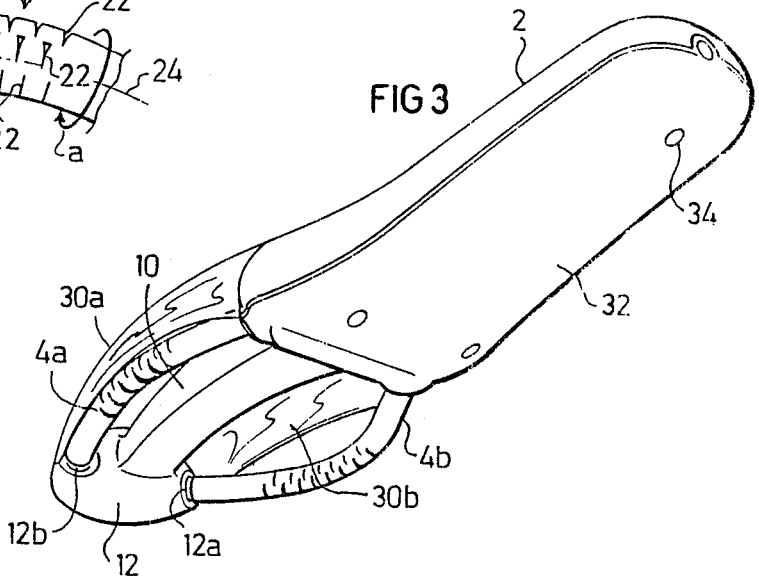
FIG. 3 is a bottom view of the device of FIG. 1.
Figure 4:
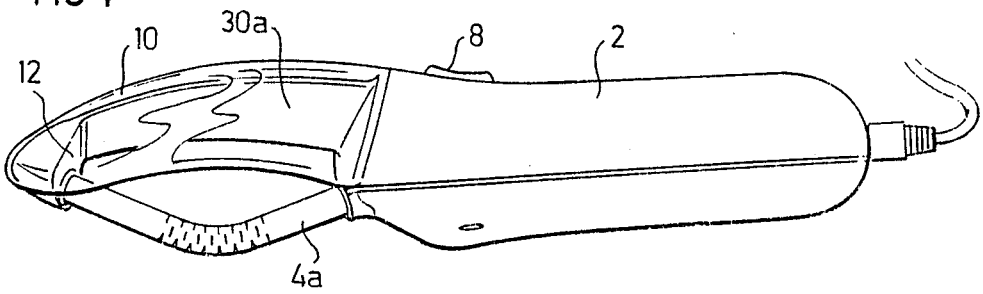
FIG. 4 is a side elevational view of the device of FIG. 1.

As shown in FIG. 3, the inner face of housing 2 is formed with a wall 32 which is substantially planar and removably secured by fasteners 34 to provide access into the interior of the housing.

In use, motor 6 drives the two hair-plucker bodies 4*a*, 4*b* in opposite directions, as shown by arrows "a" and "b" respectively, while the user moves these bodies across the skin having the hair to be removed. Hair-plucker body 4*a* is rotated clockwise, and therefore its slits 22 engage and pluck the hairs leaning in one direction and eject them upwardly through the space between the two bodies 4*1*, 4*b;* while hair-plucker body 4*b* is rotated counterclockwise, so that its slits pluck the hairs leaning in the opposite direction and eject them upwardly through the space between the two bodies. Thus, when the housing 2 is moved rightwardly (in FIG. 1), hair-plucker body 4*a* will be most effective in plucking the hairs leaning towards the left; and when the housing is moved leftwardly, hair-plucker body 4*b* will be most effective in plucking the hairs leaning towards the right. Preferably, each of the hair plucker bodies 4*a*, 4*b* forms an arc of less than 90°.

While the invention has been described with respect to one preferred embodiment, it will be appreciated that many other variations, modifications and applications of the invention may be made.

What is claimed is:

1. A depilatory device for removing body hair, comprising:

a manually-grippable housing;

two hair-plucker bodies each rotatably mounted to the housing and each having an exposed section formed with a plurality of gaps in its outer surface which open and close during the rotation of the hair-plucker body to receive, pluck and eject body hair growing on a surface over which the hair-plucker body is moved;

and a drive for driving said hair-plucker bodies in opposite directions;

each of the hair-plucker bodies including a flexible member having a cylindrical outer surface formed with said plurality of gaps extending circumferentially thereof;

the two flexible members being individually supported to define two oppositely-extending arcs having concave sides facing each other and convex side facing away from each other;

the two flexible members being rotated by said drive in opposite directions such that the gaps of one member open at its convex side and thereby tend to receive hairs leaning in one direction, and the gaps of the other member open at its convex side and thereby tend to receive hairs leaning in the opposite direction, the gaps of both members closing at their concave sides to clamp the hairs and to pluck them out during the rotation of the members in opposite directions.

2. The device according to claim 1, wherein each of said flexible members is a cylindrical member of plastic material having a smooth outer surface, said gaps being constituted with a plurality of slits penetrating only partially through the plastic cylindrical member and extending circumferentially thereof.

3. The device according to claim 1, wherein one end of one of the hair-plucker bodies is directly coupled to, and is rotated in one direction by, the electric motor within the housing, and includes a gear which is gear-coupled to the other hair-plucker body to rotate the latter in the opposite direction.

4. The device according to claim 1, wherein one end of each of the two hair-plucker bodies is rotatably mounted within the housing, and the other end of each of the two hair-plucker bodies is rotatably mounted to a stem projecting axially of the housing.

5. The device according to claim 4, wherein said stem includes a cross-arm at its outer end remote from the housing and carrying rotatable bearings for rotatably mounting the respective ends of the two hair-plucker bodies.

6. The device according to claim 4, wherein the sides of said stem include transparent shields overlying both of said hair-plucker bodies.

7. The device according to claim 6, wherein the inner side of the housing is closed by a substantially planar wall secured to the housing by fasteners and removable from the housing to provide access into its interior.

8. A depilatory device for removing body hair comprising:

a manually-grippable housing;

two hair-plucker bodies each rotatably mounted to the housing and each having an exposed section formed with a plurality of gaps in its outer surface which open and close during the rotation of the hair-plucker body to receive, pluck and eject body hair growing on a surface over which the hair-plucker body is moved;

and a drive for driving said hair-plucker bodies in opposite directions;

each of said hair-plucker bodies including a flexible cylindrical member of plastic material having a smooth outer surface, said gaps being constituted of a plurality of slits penetrating only partially through the plastic cylindrical member and extending circumferentially thereof, the two plastic cylindrical members being supported in arcuate positions to define concave sides facing each other and convex sides facing away from each other, said two plastic cylindrical members being rotated about their longitudinal axes in opposite directions, such that their slits open at their convex sides during their rotation to receive the hairs between the open confronting faces of their slits, and close at their concave sides to clamp the hairs between the closed confronting faces of the slits and to pluck them out during the rotation of the plastic cylindrical members.

9. The device according to claim 8, wherein one end of one of the hair-plucker bodies is directly coupled to, and is rotated in one direction by, the electric motor within the housing, and includes a gear which is gear-coupled to the other hair-plucker body to rotate the latter in the opposite direction.

10. The device according to claim 8, wherein one end of each of the two hair-plucker bodies is rotatably mounted within the housing, and the other end of each of the two hair-plucker bodies is rotatably mounted to a stem projecting axially of the housing.

11. The device according to claim 10, wherein said stem includes a cross-arm at its outer end remote from the housing and carrying rotatable bearings for rotatably mounting the respective ends of the two hair-plucker bodies.

12. The device according to claim 11, wherein the sides of said stem include transparent shields overlying both of said hair-plucker bodies.

13. The device according to claim 12, wherein the inner side of the housing is closed by a substantially planar wall secured to the housing by fasteners and removable from the housing to provide access into its interior.

14. A depilatory device for removing body hair, comprising:

a manually-grippable housing;

two hair-plucker bodies each rotatably mounted to the housing and each having an exposed section formed with a plurality of gaps in its outer surface which open and close during the rotation of the hair-plucker body to receive, pluck and eject body hair growing on a surface over which the hair-plucker body is moved;

the two hair-plucker bodies being individually supported to define two oppositely-extending arcs having concave sides facing each other and convex sides facing away from each other;

one end of each of the two hair-plucker bodies being rotatably mounted within the housing, and the other end of each of the two hair-plucker bodies being rotatably mounted to a stem projecting axially of the housing;

and a drive for driving said hair-plucker bodies in opposite directions.

15. The device according to claim 14, wherein each of said hair-plucker bodies includes a flexible cylindrical member of plastic material having a smooth outer surface, said gaps being constituted of a plurality of slits penetrating only partially through the plastic cylindrical member and extending circumferentially thereof, the two plastic cylindrical members being supported in arcuate positions, and being rotated about their longitudinal axes in opposite directions, such that their slits open at their convex sides during their rotation to receive the hairs between the open confronting faces of their slits, and close at their concave sides to clamp the hairs between the closed confronting faces of the slits and to pluck them out during the rotation of the plastic cylindrical members.

16. The device according to claim 14, wherein one end of one of the hair-plucker bodies is directly coupled to, and is rotated in one direction by, the electric motor within the housing, and includes a gear which is gear-coupled to the other hair-plucker body to rotate the latter in the opposite direction.

17. The device according to claim 14, wherein said stem includes a cross-arm at its outer end remote from the housing and carrying rotatable bearings for rotatably mounting the respective ends of the two hair-plucker bodies.

18. The device according to claim 14, wherein the sides of said stem include transparent shields overlying both of said hair-plucker bodies.

19. The device according to claim 14, wherein the inner side of the housing is closed by a substantially planar wall secured to the housing by fasteners and removable from the housing to provide access into its interior.

* * * * *